US005960656A

United States Patent [19]

Yao

[11] Patent Number: 5,960,656

[45] Date of Patent: Oct. 5, 1999

[54] ELECTRONIC LOCK

[75] Inventor: Celina Yao, Nan Tou Hsien, Taiwan

[73] Assignee: Shyang Feng Electric & Machinery Co., Ltd., Nan Tou Hsien, Taiwan

[21] Appl. No.: 09/145,249

[22] Filed: Sep. 2, 1998

[51] Int. Cl.[6] ..... E05B 13/10; E05B 47/00

[52] U.S. Cl. ..... 70/472; 70/223; 70/278.1; 70/279.1

[58] Field of Search ..... 70/472, 277, 278.1–278.7, 70/279.1, 280–283, 283.1, 422, 218–224; 292/144

[56] References Cited

U.S. PATENT DOCUMENTS

| | | | |
|---|---|---|---|
| 3,922,896 | 12/1975 | Kagoura | 70/223 |
| 4,625,848 | 12/1986 | Meyers et al. | 70/282 X |
| 4,956,984 | 9/1990 | Chi-Cheng | 70/277 |
| 5,010,752 | 4/1991 | Lin | 70/472 X |
| 5,018,375 | 5/1991 | Tully | 70/472 |
| 5,027,629 | 7/1991 | Liu | 70/280 X |
| 5,040,391 | 8/1991 | Lin | 70/472 X |
| 5,372,025 | 12/1994 | Lin | 70/472 |
| 5,421,178 | 6/1995 | Hamel et al. | 70/472 X |
| 5,447,047 | 9/1995 | Lin | 70/472 X |
| 5,475,996 | 12/1995 | Chen | 70/279.1 |
| 5,544,507 | 8/1996 | Lin | 70/277 X |
| 5,868,018 | 2/1999 | Kang | 70/472 |

*Primary Examiner*—Lloyd A. Gall
*Attorney, Agent, or Firm*—Rosenberg, Klein & Bilker

[57] ABSTRACT

An electronic lock according to the present invention can be used to open the door by the electronic codes and the key such that when the electronic codes fail due to the power supply being not enough, the key can be used to open the door. The electronic lock can also be used to open the door by the key when the electronic codes fail or when the user forgets the code numbers. In addition, it is easy to replace the cells of the electronic lock. Further, the electronic lock can be fitted on the right side of the door and can also be fitted on the left side of the door.

7 Claims, 9 Drawing Sheets

ELECTRONIC LOCK

BACKGROUND OF THE INVENTION

1. Field of the Invention

The present invention relates to an electronic lock.

2. Description of the Related Prior Art

A conventional electronic lock can be used to open the door by means of controlling the electronic codes only. However, such a conventional electronic lock has the following disadvantages:

1. The conventional electronic lock can be used to open the door by the electronic codes only such that the electronic lock cannot be used to open the door when the electronic codes fail due to the power supply being not enough or due to the user forgetting the code numbers.

2. The user has to remove the inner lock body from the door so as to replace the cells, thereby causing inconvenience when it is intended to replace the cells.

3. The conventional electronic lock includes a magnet block received in coil. However, the magnet block is not efficiently positioned in place, thereby easily causing difficulty to open the door by the electronic lock.

4. The conventional electronic lock can be fitted on the right side or the left side of the door only.

The present invention has arisen to overcome the disadvantages of the conventional electronic lock.

SUMMARY OF THE INVENTION

According to one aspect of the present invention, there is provided an electronic lock comprising an outer lock body, a plurality of press buttons mounted on the outer lock body, an outer handle pivotally mounted on the outer lock body, a first positioning piece mounted in the outer lock body and fixedly attached to the outer handle, and a first circular return spring mounted in the outer lock body and pressing the first positioning piece.

A lock core unit comprises a lock core rotatably mounted in the outer handle and having a first end exposing outward of the outer handle and forming a key hole and a second end formed with two driving blocks, and an actuating sleeve rotatably mounted in the outer handle and having one end formed with two actuating blocks abutting each of the two driving blocks, two arcuate sliding slots each formed in the periphery of the actuating sleeve and each having a first end and a second end lower than the first end, a pressing piece mounted in the actuating sleeve and having two ends each slidably received in each of the two sliding slots, and a compression spring mounted in the actuating sleeve and abutting the pressing piece.

A lock bar unit comprises a seat sleeve mounted in the outer body, a locking base mounted in the seat sleeve and having a first side formed with a lug fixedly mounted in the first positioning piece and a second side forming a first locking recess, a stepped hole axially formed in the locking base, a push shaft slidably mounted in the stepped hole and having a first end abutting the pressing piece and a second end, a first return spring mounted in the stepped hole and abutting the push shaft, a coil base mounted in the seat sleeve and having a first side forming a second locking recess aligning with the first locking recess and a second side, a coil received in the coil base, a magnet block received in the coil, a shaft received in the magnet block, a locking block slidably mounted on the shaft and pressed by the push shaft to be movable between the first locking recess and the second locking recess, a second return spring mounted between the locking block and the magnet block, a lock bar base having a first side fixedly mounted on the second side of the coil base and a second side, and a lock bar having a first end fixedly mounted in the second side of the lock bar base, a mediate portion, and a second end.

A latch has one end fitted on the mediate portion of the lock bar. An inner handle is pivotally mounted on an inner lock body. A second positioning piece is mounted in the inner lock body, fixedly attached to the inner handle and fixedly mounted on the second end of the lock bar. A second circular return spring is mounted in the inner lock body and presses the second positioning piece.

Further objectives and advantages of the present invention will become apparent after a careful reading of the detailed description with appropriate reference to the accompanying drawings.

DETAILED DESCRIPTION OF THE PREFERRED EMBODIMENTS

Figure 1:
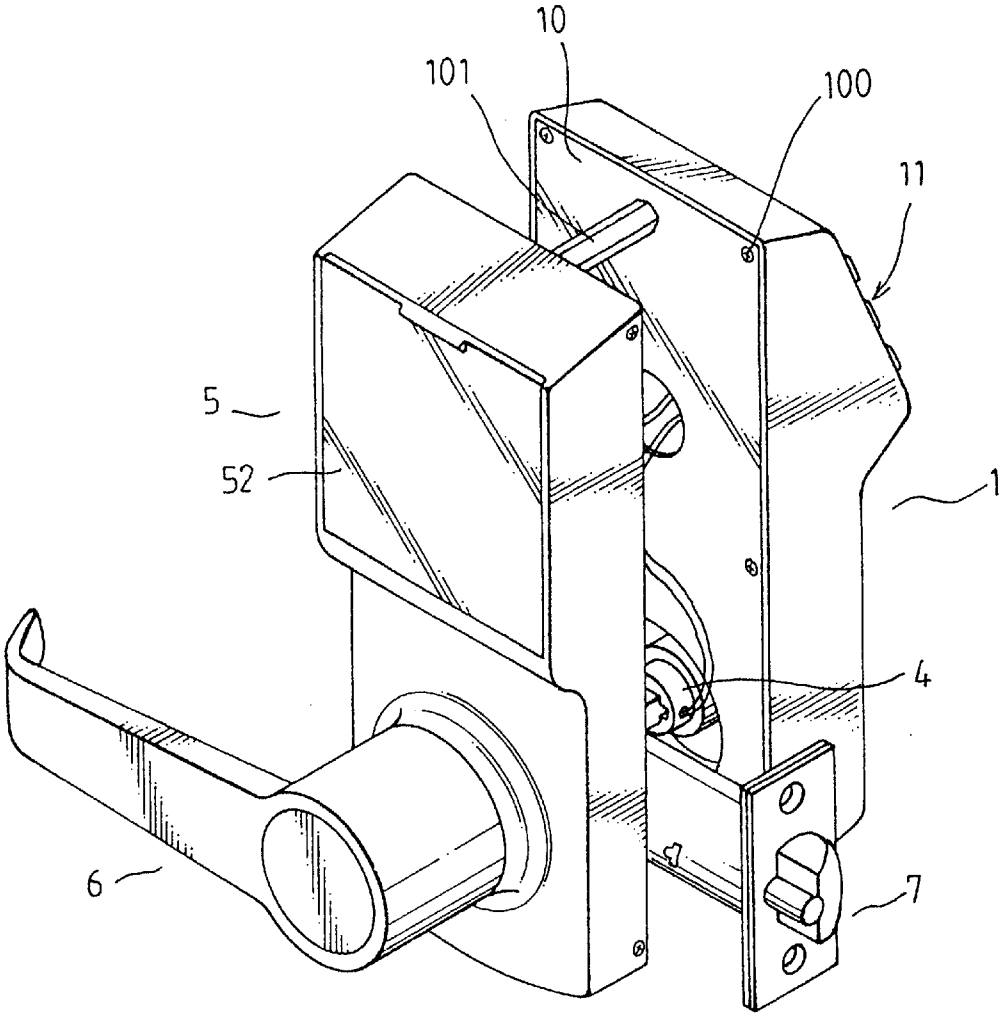
FIG. 1 is a perspective view of an electronic lock according to the present invention.
Figure 2:
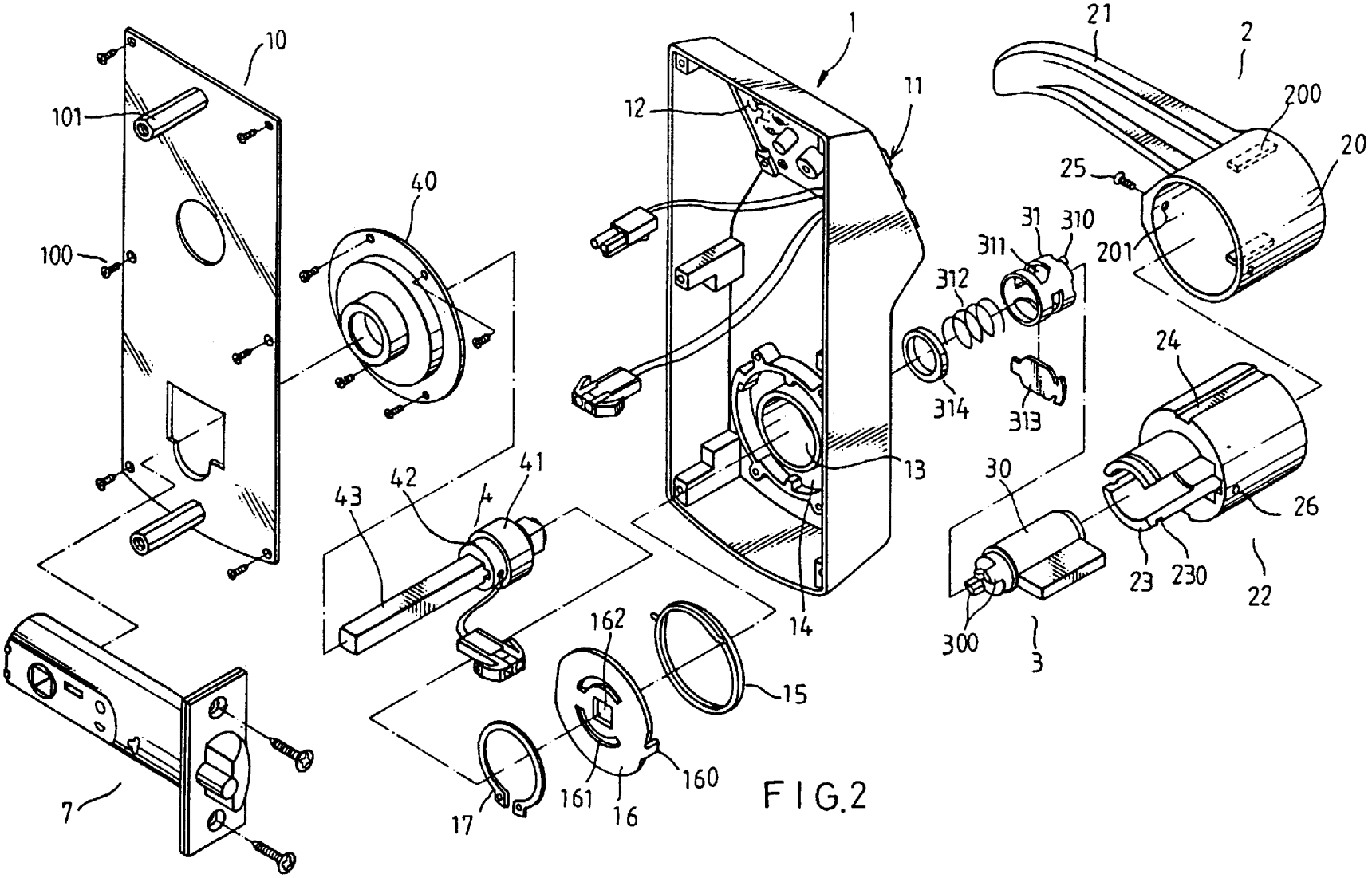
FIGS. 2–4 are partially exploded views of the electronic lock shown in FIG. 1.
Figures 3, 3A:
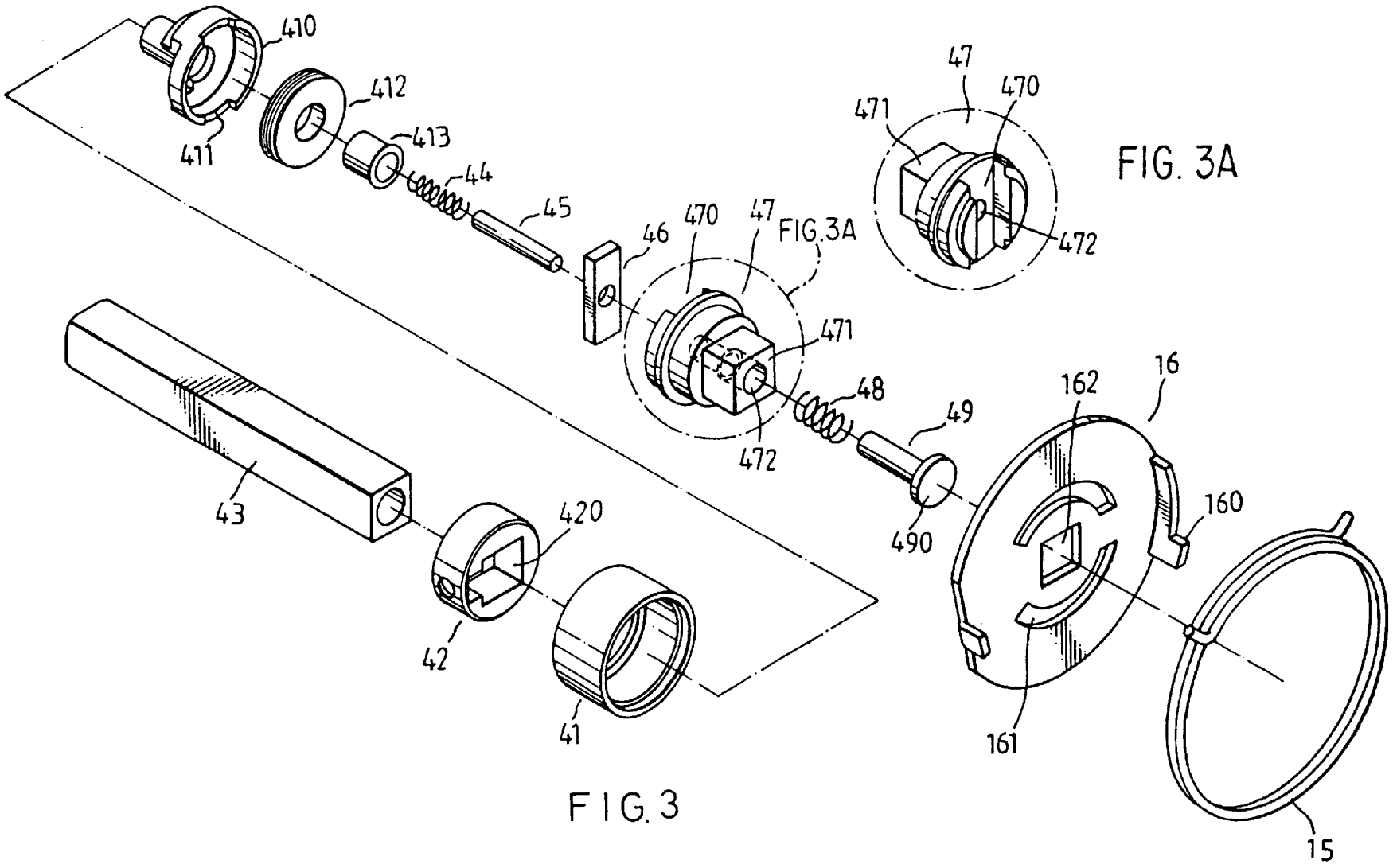
Figure 4:
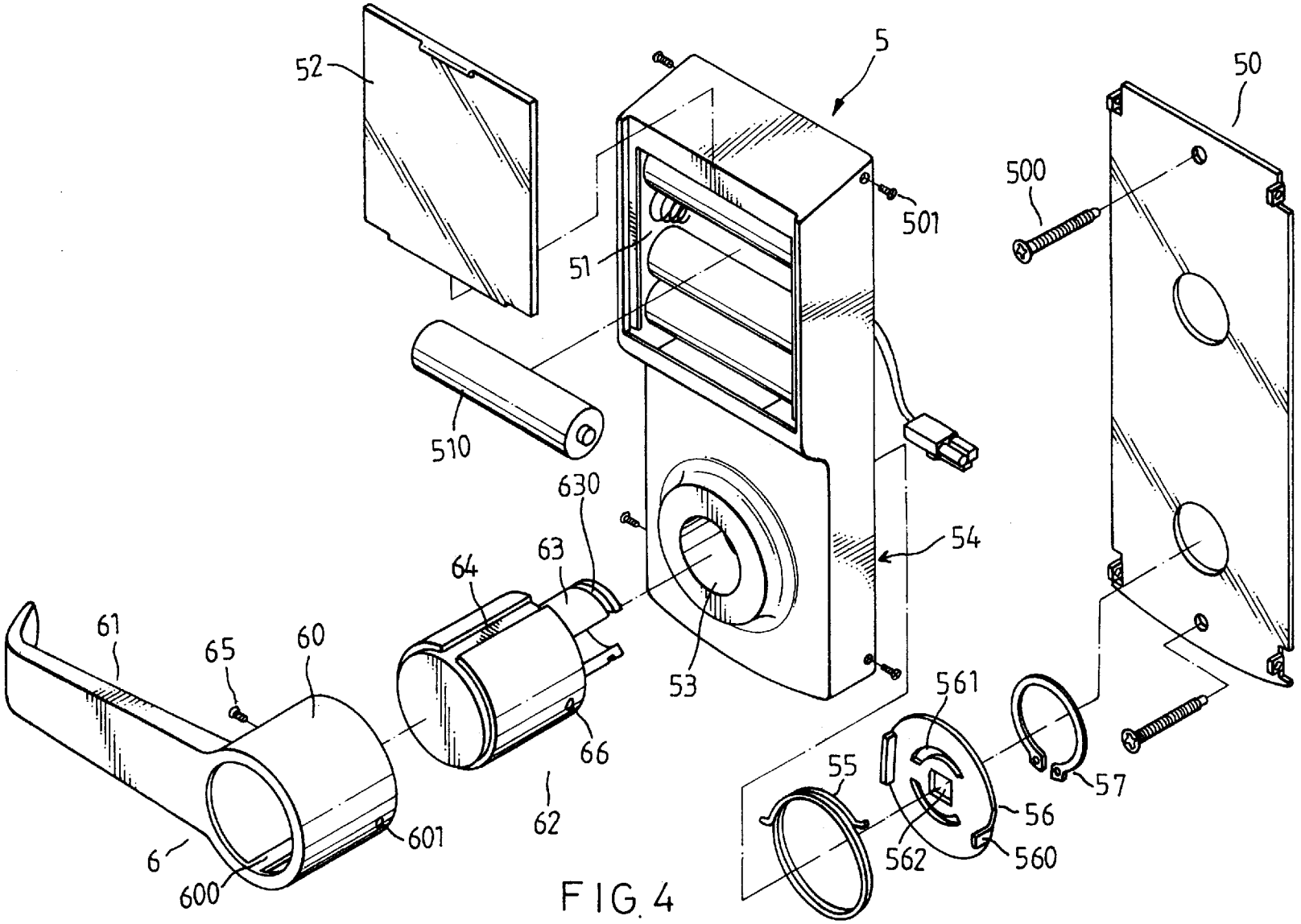

Referring now to FIGS. 1–6, an electronic lock according to the present invention comprises an outer lock body 1, a plurality of press buttons 11 mounted on the outer lock body 1, a circuit board 12 mounted in the outer lock body 1, an outer handle pivot hole 13 formed in the outer lock body 1, and an annular spring groove 14 formed in the outer lock body 1 and located outward of the outer handle pivot hole 13.

An outer handle 2 is pivotally mounted on the outer lock body 1, and includes a handgrip 21 and a socket 20, two radially opposing elongated lugs 200 each mounted on the inner wall of the socket 20, and two radially opposing threaded holes 201 each formed in the inner wall of the socket 20.

An outer handle pivot block 22 is fixedly mounted in the socket 20, two radially opposing elongated grooves 24 are each formed in the outer wall of the outer handle pivot block 22 for receiving the lug 200, two radially opposing fixed holes 26 are each formed in the outer wall of the outer handle pivot block 22, and two positioning screws 25 each extend through the threaded hole 201 and the fixed hole 26, thereby securing the outer handle pivot block 22 in the socket 20. The outer handle pivot block 22 includes two arcuate pieces 23 each rotatably received in the outer handle pivot hole 13 and each forming a snapping groove 230.

A lock core unit 3 comprises a lock core 30 rotatably mounted in the outer handle block 22 of the outer handle 2 and having a first end exposing outward of the outer handle 2 and forming a key hole 302 and a second end formed with two driving blocks 300, and an actuating sleeve 31 rotatably mounted between the two arcuate pieces 23 of the outer handle pivot block 22 and having a first end formed with two actuating blocks 310 each abutting and driven by each of the two driving blocks 300 and a second end, two arcuate sliding slots 311 each formed in the periphery of the actuating sleeve 31 and each having a first end and a second end lower than the first end, a pressing piece 313 mounted in the actuating sleeve 31 and having two ends each slidably received in each of the two sliding slots 311 and each limited between the two arcuate pieces 23, a compression spring 312 mounted in the actuating sleeve 31 and abutting the pressing piece 313, and a washer 314 abutting the second end of the actuating sleeve 31.

A first positioning piece 16 is fixedly mounted on the two arcuate pieces 23 of the outer handle pivot block 22 and abuts the washer 314, two arcuate slots 161 are each formed in the first positioning piece 16 for receiving the arcuate piece 23, a center hole 162 is formed in the first positioning piece 16, two radially opposing limiting ears 160 are formed on the periphery of the first positioning piece 16, a first circular return spring 15 is mounted in the spring groove 14 of the outer lock body 1 and pressing each of the two limiting ears 160 of the first positioning piece 16, and a snapping ring 17 is secured into the snapping groove 230 of each of the arcuate pieces 23.

A lock bar unit 4 comprises a lock bar cap 40 fixedly mounted to the outer handle pivot hole 13 of the outer lock body 1, a seat sleeve 41 mounted in the lock bar cap 40, a locking base 47 mounted in the seat sleeve 41 and having a first side formed with a lug 471 fixedly mounted in the center hole 162 of the first positioning piece 16 and a second side forming a first locking recess 470 therein, a stepped hole 472 axially formed in the locking base 47, a push shaft 49 slidably mounted in the stepped hole 472 and having a first end abutting the pressing piece 313 and a second end, a first return spring 48 mounted in the stepped hole 472 and abutting the head 490 of the push shaft 49, a coil base 410 mounted in the seat sleeve 41 and having a first side forming a second locking recess 411 aligning with the first locking recess 470 and a second side, a coil 412 received in the coil base 410, a magnet block 413 received in the coil 412, a shaft 45 received in the magnet block 413, a locking block 46 made of metallic material being slidably mounted on the shaft 45 and pressed by the push shaft 49 to be movable between the first locking recess 470 and the second locking recess 411, a second return spring 44 mounted between the locking block 46 and the magnet block 413, a lock bar base 42 having a first side fixedly mounted on the second side of the coil base 410 and a second side, and a lock bar 43 having a first end fixedly mounted in the center hole 420 formed in the second side of the lock bar base 42, and having a second end.

A latch 7 has a first end fitted on the mediate portion of the lock bar 43, and a second end with a bolt 70 slidably mounted therein.

The electronic lock further comprises an inner lock body 5 formed with a compartment 51 for containing a plurality of cells 510 therein, and a cap 52 mounted on the inner lock body 5 for closing the compartment 51. An inner handle pivot hole 53 is formed in the inner lock body 5, and an annular spring groove 54 is formed in the inner lock body 5 and located outward of the inner handle pivot hole 53.

An inner handle 6 is pivotally mounted on the inner lock body 5 and includes a handgrip 61 and a socket 60, two radially opposing elongated lugs 600 each mounted on the inner wall of the socket 60, and two radially opposing threaded holes 601 each formed in the inner wall of the socket 60.

An inner handle pivot block 62 is fixedly mounted in the socket 60, two radially opposing elongated grooves 64 are each formed in the outer wall of the inner handle pivot block 62 for receiving the lug 600, two radially opposing fixed holes 66 are each formed in the outer wall of the inner handle pivot block 62, and two positioning screws 65 each extend through the threaded hole 601 and the fixed hole 66, thereby securing the inner handle pivot block 62 in the socket 60. The inner handle pivot block 62 includes two arcuate pieces 63 each rotatably received in the inner handle pivot hole 53 and each forming a snapping groove 630.

A second positioning piece 56 is fixedly mounted on the two arcuate pieces 63 of the inner handle pivot block 62, two arcuate slots 561 are each formed in the second positioning piece 56 for receiving the arcuate piece 63, a center hole 562 is formed in the second positioning piece 56 for receiving the second end of the lock bar 43, two radially opposing limiting ears 560 are formed on the periphery of the second positioning piece 56, a second circular return spring 55 is mounted in the spring groove 54 of the inner lock body 5 and pressing each of the two limiting ears 560 of the second positioning piece 56, and a second snapping ring 57 is secured into the snapping groove 630 of each of the arcuate pieces 63.

Figure 5:
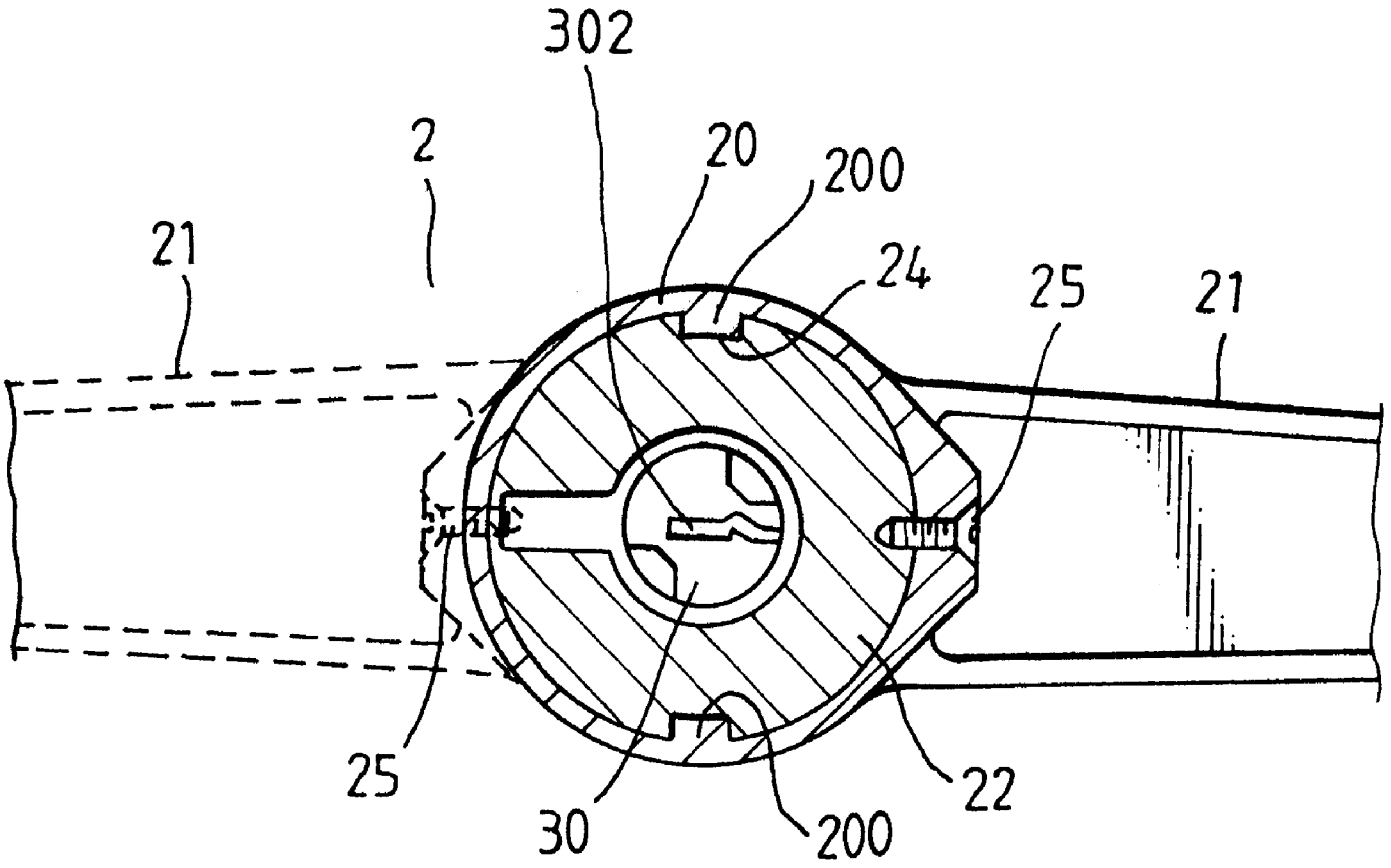
FIG. 5 is side cross-sectional view of the electronic lock shown in FIG. 1.
Figure 6:
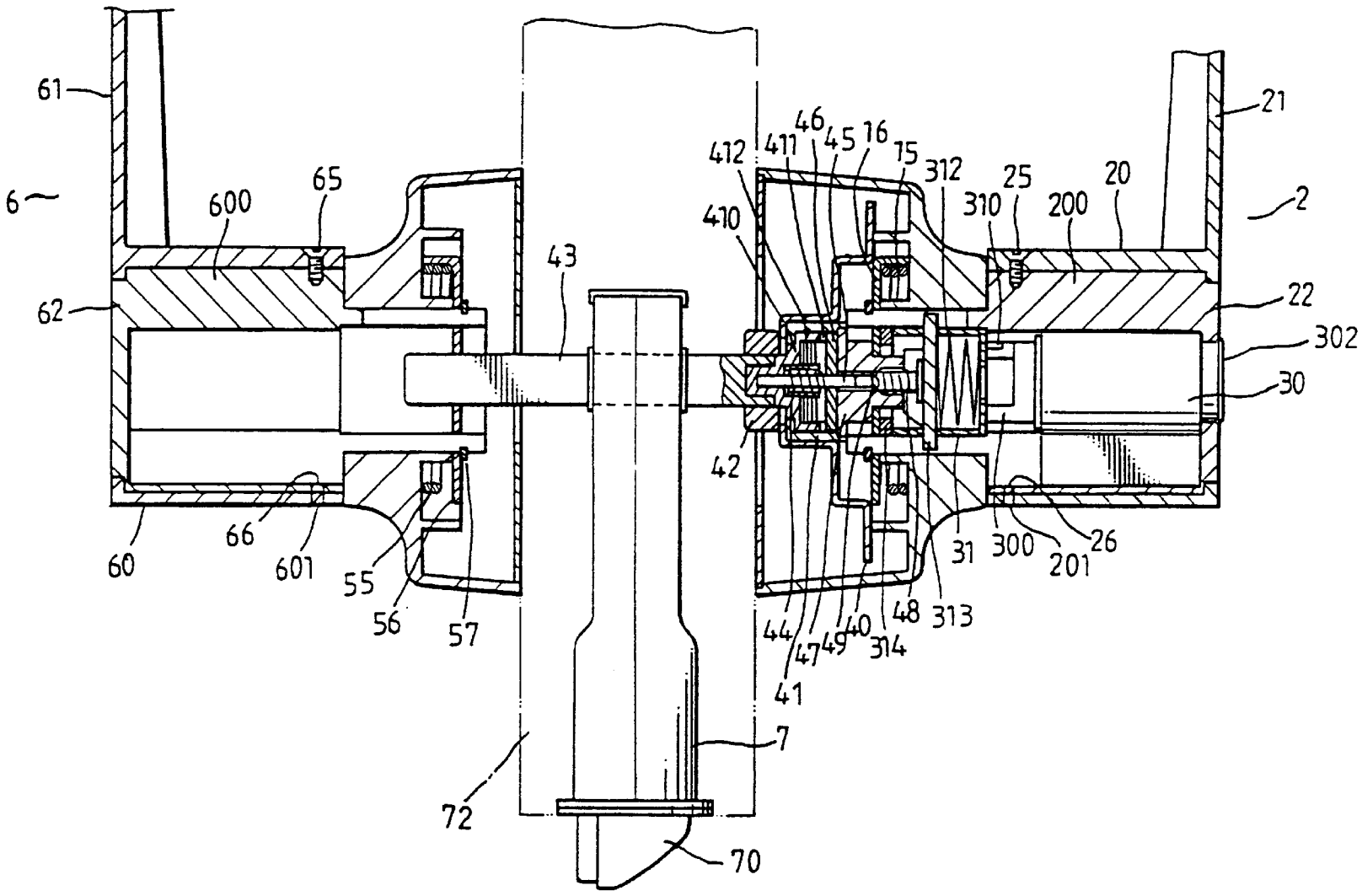
FIG. 6 is top cross-sectional view of the electronic lock shown in FIG. 1.

In assembly, referring to FIG. 6 with reference to FIG. 1–5, the latch 7 is initially fitted into a door plate 72. The outer lock body 1 can then be fixed to an outer lock body plate 10 by means of a plurality of screws 100, and the outer lock body plate 10 is formed with two threaded posts 101 each extending through the outer side of the door plate 72. An inner lock body plate 50 can then be mounted to the inner side of the door plate 72, and two positioning screws 500 can each extend through the inner lock body plate 50 and are each engaged in one of the two threaded posts 101, thereby securing the inner lock body plate 50 and the outer lock body plate 10 to the door plate 72. The inner lock body 5 can then be fixed to the inner lock body plate 50 by means of a plurality of screws 501.

Figure 7:
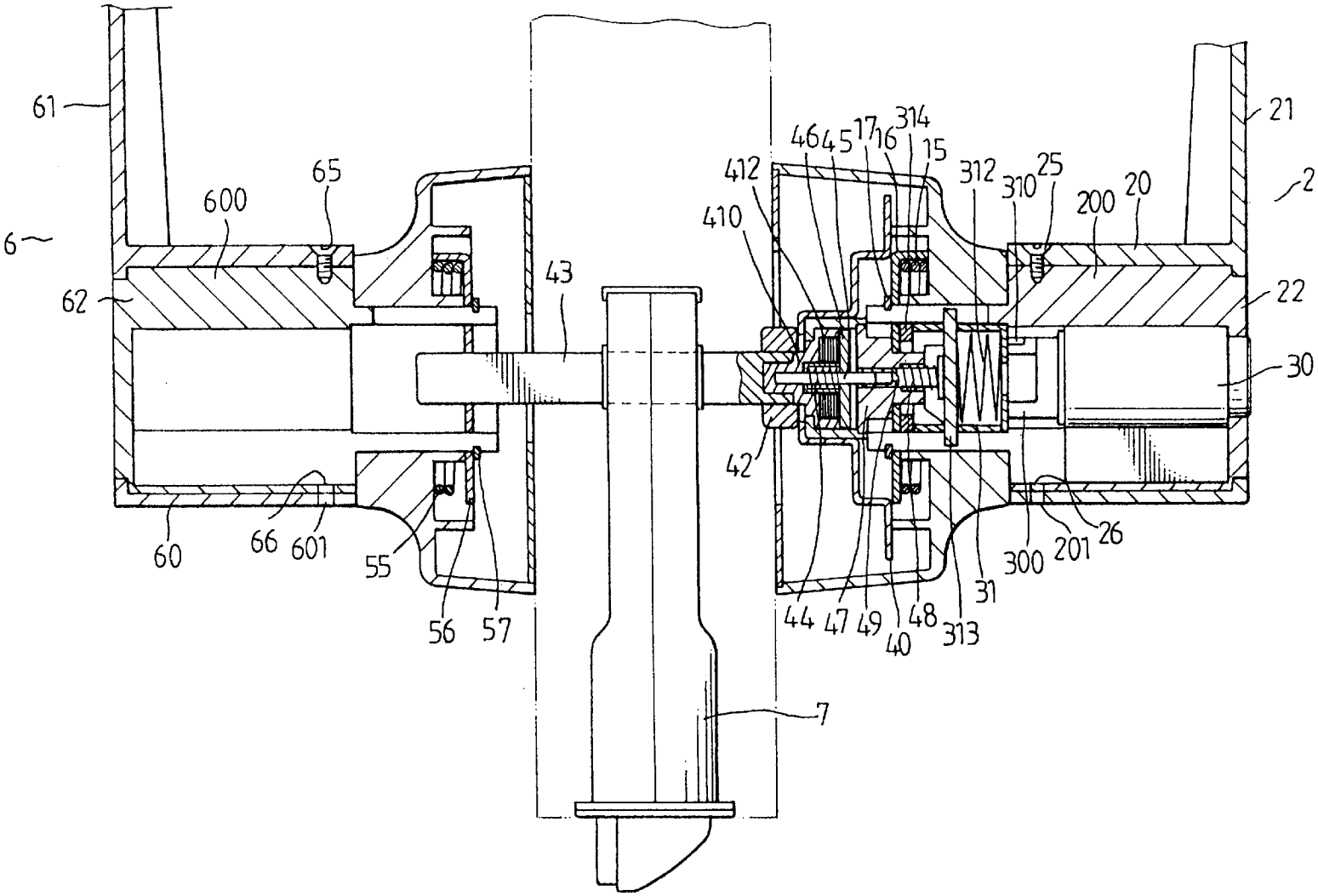
FIG. 7 is an operational view of FIG. 6.

In operation, referring to FIGS. 6 and 7 with reference to FIGS. 1–5, when it is intended to operate the electronic lock by means of electricity, the press buttons 11 can be pressed to match the code set by the user. The circuit board 12 can be opened when the code inputted is correct, thereby conducting current into the coil 412 such that the magnetic block 413 received in the coil 412 can induce magnetic force, thereby attracting the locking block 46 which can be moved on the shaft 45 from the position as shown in FIG. 6 to the position as shown in FIG. 7 to be partially received into the second locking recess 411 such that the coil base 410 can be rotated in concert with the locking base 47 due to the locking block 46 being locked between the first locking recess 470 and the second locking recess 411.

In such a situation, the outer handle 2 can be rotated relative to the outer lock body 1 to rotate the outer handle pivot block 22 which can then rotate the first positioning piece 16 by means of the arcuate pieces 23 to rotate the lug 471 of the locking base 47 which rotates the coil base 410 which rotates the lock bar base 42 which rotates the first end of the lock bar 43 which can co-operate with the latch 7 to retract the bolt 70, thereby opening the door.

When the circuit board 12 is closed, the magnetic action exerted on the locking block 46 by the magnet block 413 disappears, thereby detaching the locking block 46 from the second locking recess 411 by means of the second return spring 44 such that the locking base 47 idles when rotating the outer handle 2, thereby locking the door.

Figure 8:
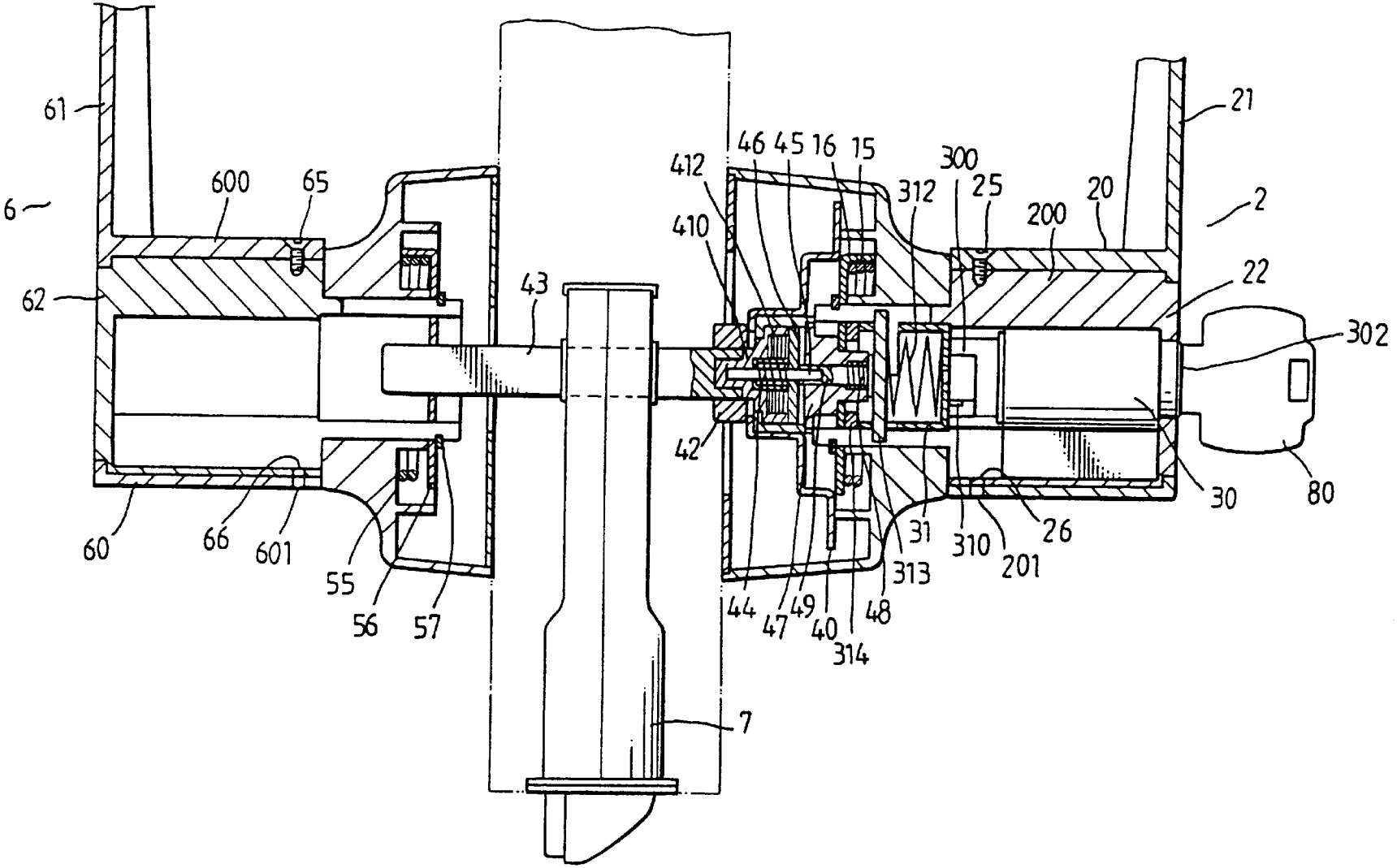
FIG. 8 is top cross-sectional operational view of the electronic lock shown in FIG. 1.

Referring now to FIG. 8 with reference to FIGS. 1–5, when it is intended to operate the electronic lock manually, a key 80 can be inserted into the key hole 302 so as to rotate the lock core 30 in the outer handle pivot block 22 which can rotate the actuating sleeve 31 by means of the driving blocks 300 meshing with the actuating blocks 310. When the actuating sleeve 31 is rotated, the pressing piece 313 is limited by the shape of the sliding slots 311 and the arcuate pieces 23 so as to move forward, thereby pressing the push shaft 49 which pushes the locking block 46 which can be moved on the shaft 45 to be partially received into the second locking recess 411 such that the coil base 410 can be rotated in concert with the locking base 47 due to the locking block 46 being locked between the first locking recess 470 and the second locking recess 411. In such a situation, the outer handle 2 can be rotated relative to the outer lock body 1 to rotate the outer handle pivot block 22 which can then rotate the first positioning piece 16 by means of the arcuate pieces 23 to rotate the lug 471 of the locking base 47 which rotates the coil base 410 which rotates the lock bar base 42 which rotates the first end of the lock bar 43 which can co-operate with the latch 7 to retract the bolt 70, thereby opening the door.

The actuating sleeve 31 can be rotated along a reverse direction by means of rotating the key 80 to it original position. When the actuating sleeve 31 is rotated, the pressing piece 313 is limited by the shape of the sliding slots 311 and the arcuate pieces 23 so as to move backward, thereby releasing the push shaft 49 by means of the first return spring 48 and releasing the locking block 46 by means of the second return spring 44 so as to detach the locking block 46 from the second locking recess 411 such that the locking base 47 idles when rotating the outer handle 2, thereby locking the door.

When it is intended to open the door from inside, the inner handle 6 can be rotated relative to the inner lock body 5 to rotate the inner handle pivot block 62 which can then rotate the second positioning piece 56 by means of the arcuate pieces 63, thereby rotating the second end of the lock bar 43 which can co-operate with the latch 7 to retract the bolt 70, thereby opening the door.

Figures 9, 9A:
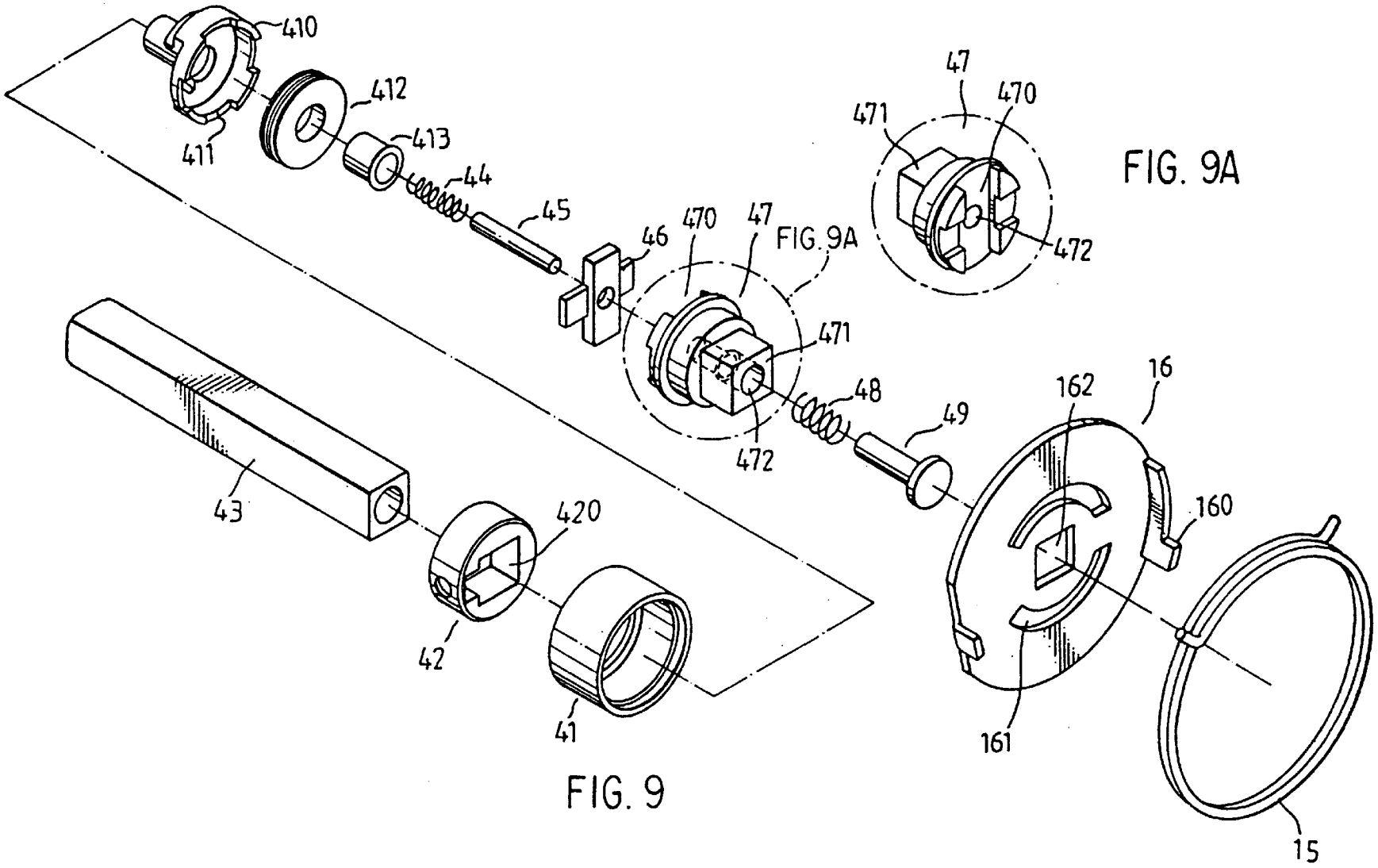
FIG. 9 is a partially exploded view of an electronic lock according to a second embodiment of the present invention.

Referring now to FIG. 9, according to a second embodiment of the present invention, the locking block 46, the first locking recess 470 and the second locking recess 411 are cross-shaped.

Accordingly, the electronic lock according to the present invention has the following advantages:

1. The electronic lock can be used to open the door when the power supply is not enough: The electronic lock is used to open the door by the electronic codes and the key such that when the electronic codes fail due to the power supply being not enough, the key can be used to open the door.

2. The key can be used to open the door when the electronic codes fail: The electronic lock is used to open the door by the electronic codes and the key such that when the electronic codes fail or the user forgets the codes, the key can be used to open the door.

3. It is easy to replace the cells: When it is intended to replace the cells, the user just needs to remove the cap from the inner lock body so as to replace the cells.

4. The electronic lock can be fitted on the right side or the left side of the door: As shown in FIG. 5, the outer handle 2 is mounted on the inner handle pivot block 22 by means of each of the two elongated blocks 200 being received in the elongated groove 24 such that the handgrip 21 of the outer handle 2 can be located to the right side of the outer handle pivot block 22 as shown in solid lines or located to the right side of the outer handle pivot block 22 as shown in phantom lines. In such a manner, the electronic lock can be fitted on the right side or the left side of the door.

Although the present invention has been described with a certain degree of particularity, it is to be understood that the present disclosure has been made by way of example only and that many other possible modifications and variations can be made without departing from the scope and spirit of the present invention.

I claim:

1. An electronic lock comprising:

an outer lock body, a plurality of press buttons mounted on said outer lock body, an outer handle pivotally mounted on said outer lock body, a first positioning piece mounted in said outer lock body and fixedly attached to said outer handle, a first circular return spring mounted in said outer lock body and pressing said first positioning piece;

a lock core unit comprising a lock core rotatably mounted in said outer handle and having a first end exposing outward of said outer handle and forming a key hole and a second end formed with two driving blocks, and an actuating sleeve rotatably mounted in said outer handle and having one end formed with two actuating blocks abutting each of said two driving blocks, two arcuate sliding slots each formed in the periphery of said actuating sleeve and each having a first end and a second end lower than said first end, a pressing piece mounted in said actuating sleeve and having two ends slidably received in each of said two sliding slots, and a compression spring mounted in said actuating sleeve and abutting said pressing piece;

a lock bar unit comprising a seat sleeve mounted in said outer lock body, a locking base mounted in said seat sleeve and having a first side formed with a lug fixedly mounted in said first positioning piece and a second side forming a first locking recess, a stepped hole axially formed in said locking base, a push shaft slidably mounted in said stepped hole and having a first end abutting said pressing piece and a second end, a first return spring mounted in said stepped hole and abutting said push shaft, a coil base mounted in said seat sleeve and having a first side forming a second locking recess aligning with said first locking recess and a second side, a coil received in said coil base, a magnet block received in said coil, a shaft received in said magnet block, a locking block sidably mounted on said shaft and pressed by said push shaft to be movable between said first locking recess and said second locking recess, a second return spring mounted between said locking block and said magnet block, a lock bar base having a first side fixedly mounted on said second side of said coil base and a second side, and a lock bar having a first end fixedly mounted in said second side of said lock bar base, a mediate portion, and a second end;

a latch having one end fitted on said mediate portion of said lock bar;

an inner lock body, an inner handle pivotally mounted on said inner lock body, a second positioning piece mounted in said inner lock body, fixedly attached to said inner handle and fixedly mounted on said second end of said lock bar, and a second circular return spring mounted in said inner lock body and pressing said second positioning piece.

2. The electronic lock as claimed in claim 1, wherein said outer handle is formed with a socket, two radially opposing elongated lugs each mounted on the inner wall of said socket, two radially opposing threaded holes each formed in the inner wall of said socket, an outer handle pivot block fixedly mounted in said socket, two radially opposing elongated grooves each formed in the outer wall of said outer handle pivot block for receiving said lugs two radially opposing fixed holes each formed in the outer wall of said outer handle pivot block, and two positioning screws each extending through said threaded holes and said fixed holes.

3. The electronic lock as claimed in claim 2, wherein said outer handle pivot block includes two arcuate pieces each fixedly connected with said first positioning piece.

4. The electronic lock as claimed in claim 1, wherein said inner handle is formed with a socket, two radially opposing elongated lugs each mounted on the inner wall of said socket, two radially opposing threaded holes each formed in the inner wall of said socket, an inner handle pivot block fixedly mounted in said socket, two radially opposing elongated grooves each formed in the outer wall of said inner handle pivot block for receiving said lugs, two radially opposing fixed holes each formed in the outer wall of said inner handle pivot block, and two positioning screws each extending through said threaded holes and said fixed holes.

5. The electronic lock as claimed in claim 4, wherein said inner handle pivot block includes two arcuate pieces each fixedly connected with said second positioning piece.

6. The electronic lock as claimed in claim 1, wherein said inner lock body is formed with a compartment for containing a plurality of cells therein, and a cap mounted on said inner lock body for closing said compartment.

7. The electronic lock as claimed in claim 1, wherein said locking block, said first locking recess and said second locking recess are cross-shaped.

* * * * *